US005890406A

United States Patent [19]

Thorn

[11] Patent Number: 5,890,406

[45] Date of Patent: Apr. 6, 1999

[54] ELECTRONIC TORQUE LIMITING AND PARTS MARKING WRENCH

[75] Inventor: Brent Thorn, Plymouth, Mich.

[73] Assignee: Jane Figueiredo, Beverly Hills, Mich.

[21] Appl. No.: 596,920

[22] Filed: Mar. 13, 1996

Related U.S. Application Data

[63] Continuation-in-part of Ser. No. 287,968, Aug. 9, 1994, Pat. No. 5,467,674.

[51] Int. Cl.[6] ..... B25B 23/145

[52] U.S. Cl. ..... 81/468; 81/479

[58] Field of Search ..... 81/467, 468, 472–478, 81/480–483

[56] References Cited

U.S. PATENT DOCUMENTS

| | | | |
|---|---|---|---|
| 3,667,327 | 6/1972 | Lance | 81/468 |
| 4,393,734 | 7/1983 | Thorn et al. | 81/468 |
| 4,561,332 | 12/1985 | Wood | 81/479 |
| 5,172,616 | 12/1992 | Negishi | 81/479 |
| 5,394,775 | 3/1995 | Fagerstrom | 81/479 |

FOREIGN PATENT DOCUMENTS

| | | | |
|---|---|---|---|
| 133557 | 2/1985 | European Pat. Off. | 81/479 |
| 2829009 | 1/1980 | Germany | 81/479 |
| 3026134 | 2/1982 | Germany | 81/479 |
| 3324333 | 1/1985 | Germany | 81/479 |
| 4152070 | 5/1992 | Japan | 81/479 |

*Primary Examiner*—David A. Scherbel
*Assistant Examiner*—Joni B. Danganan
*Attorney, Agent, or Firm*—Dinnin & Dunn, P.C.

[57] ABSTRACT

An improved combined torque limiting and part marking wrench according to the present invention includes: a torque-applying handle; a housing pivotally mounted to the handle, the housing adapted to receive a releasably mounted, replaceable, part-engaging head assembly at a second end thereof; and a part-marking mechanism mounted within the housing. The part-marking mechanism includes a marking tip which passes through a bore in the head assembly for marking a part. A mechanical linkage arm is pivotally connected to the torque-applying handle. A pivotable cam is pivotally connected to the linkage arm and in operative engagement with the part-marking mechanism for moving the marking tip through the bore, such that, when torque on a part has reached a predetermined value, the torque applying handle moves the linkage arm, which pivots the pivotable cam, thus forcing the pivotable cam against the part marking mechanism, which causes the marking tip to extend outwardly from the housing to mark the part. An alternative torque limiting and part-marking wrench according to the present invention includes a marking tube connected at an angle to the housing and a pair of cammingly engaged plungers which actuate the part-marking mechanism. A load cell may also be included with the electronic push button switch. The load cell will digitally read the force of tension, convert it to torque lbs and display it on a monitor.

9 Claims, 3 Drawing Sheets

ELECTRONIC TORQUE LIMITING AND PARTS MARKING WRENCH

This is a continuation-in-part of the U.S. patent application Ser. No. 08/287,968 filed Aug. 9, 1994 now U.S. Pat. No. 5,467,674.

BACKGROUND OF THE INVENTION

1. Field of the Invention

The present invention relates to a torque limiting wrench, and more particularly to a torque limiting wrench having a marking mechanism which marks a part when the part has been manipulated to a desired level of torque.

2. Description of Related Art

Torque limiting wrenches have applications in various manufacturing environments where application of a consistent level of torque is needed. There are numerous reasons for desiring consistency in application of torque in a manufacturing process, such as avoiding localized stressing of parts and assuring full tightening of fasteners. Application of too great a torque or over tightening in assembling a fastener can cause the fastener to fail, thus torque limiting wrenches such as U.S. Pat. Nos. 4,393,734, 3,523,471 and 3,667,327 have been developed and are well known in the art. Further, however, it is important for fasteners to be properly tightened through application of a specified amount of torque.

It would be desirable for a manufacturing quality inspector to be able to visually check the level of torque applied to fasteners in a manufacturing environment. My previous patent, U.S. Pat. No. 4,393,734, herein incorporated by reference, discloses an invention which provides this inspection capability. This invention uses a pneumatic line to create pressure in a torque limiting wrench housing when the desired level of torque is reached. This pressure causes an ink-marking unit to slide toward the part and create a visible mark for visual confirmation that the fastener has been properly "torqued" (assembled with the appropriate torque).

There are several limitations of my previous invention. The attachment of a pneumatic line may limit the functional use of a tool in a manufacturing environment. It may also be difficult, cumbersome and costly to provide pneumatic lines to certain locations in a manufacturing facility or assembly line. In addition, the attachment of these pneumatic lines may limit the travel of the unit, i.e., the ability of the user to walk around and perform work in areas where work space is limited, areas where pneumatic lines are unavailable, or outside.

Another limitation with my previous invention is the inefficiencies of the metal-tipped striking pins. Large pneumatic line pressures are required in order to sufficiently force the striking pin against the part to mark the part. Further, there is only the physical mark to verify proper torque.

Therefore, it would be desirable to develop a combined electronic torque limiting and marking wrench which does not have the previously mentioned limitations.

SUMMARY OF THE INVENTION

An improved electronic torque limiting and part marking wrench according to the present invention includes: a torque-applying handle; a housing pivotally mounted to the handle, the housing adapted to receive a releasably mounted, replaceable, part-engaging head assembly at a second end thereof; and a part-marking mechanism mounted within the housing. The part-marking mechanism includes a felt marking tip which passes through a bore in the head assembly for marking a part. A mechanical linkage arm is pivotally connected to the torque-applying handle. A pivotable cam is pivotally connected to the linkage arm and in operative engagement with the part-marking mechanism for moving the marking tip through the bore, such that, when torque on a part has reached a predetermined value, the torque applying handle moves the linkage arm, which pivots the pivotable cam, thus forcing the second end of the pivotable cam against the part marking mechanism, which causes the marking tip to extend outwardly from the housing to mark the part. An electronic switch which activates on when a part has reached a predetermined torque.

An alternative torque limiting and part-marking wrench according to the present invention includes a torque-applying handle and a housing pivotally mounted to the torque applying handle. A first plunger is slidably movable within a bore in the housing. A mechanical linkage arm pivotally connects the torque-applying handle to a pivotable cam. The pivotable cam is in operative engagement with the first plunger for sliding the first plunger along the bore. A marking tube is connected to the housing and is adapted to receive a releasably mounted, replaceable, part-engaging head assembly. The axis of the tube is at an angle relative to the axis of the first plunger. A second plunger is slidably movable within the marking tube and has a cammed end in camming engagement with a cammed end of the first plunger. A part marking mechanism is located within the marking tube, and includes a marking tip which passes through a bore in the head assembly. The part marking assembly is slidably movable within the marking tube, such that, when torque on a part has reached a predetermined value, the torque-applying handle moves the linkage arm, which pivots the pivotable cam, and forces the pivotable cam against the first plunger, sliding the first plunger along the bore, which causes the cammed surfaces of the first and second plungers to engage, and the second plunger slides along the marking tube, which moves the part marking mechanism toward the part to be marked, and the marking tip extends outwardly from the tube to mark the part.

Accordingly, an object of the present invention is to provide a combination torque limiting and marking wrench which is universally moveable, in that it requires no pneumatic or electric attachments.

A further object of the present invention is to provide an electronic connection to the torque wrench to electronically inventory marked parts.

Another object of the present invention is to provide a physical mark and an electronic record for torqued parts.

Yet another object of the present invention is to provide a combined torque limiting and marking wrench in which the ink cartridge and marking tip are easily replaceable.

Another object of the present invention is to provide a combined torque limiting and marking wrench in which the part-engaging head assembly is at an angle relative to the handle to allow for part manipulation in limited working spaces.

A still further object of the present invention is to provide a combined torque limiting and marking wrench without a metal striking pin, thereby eliminating the need for pneumatic pressure to force the striking pin against a part to be marked.

These and other objects, features and advantages of the present invention will be more thoroughly understood with reference to the accompanying drawings and description.

BEST MODES FOR CARRYING OUT THE INVENTION

Figure 1:
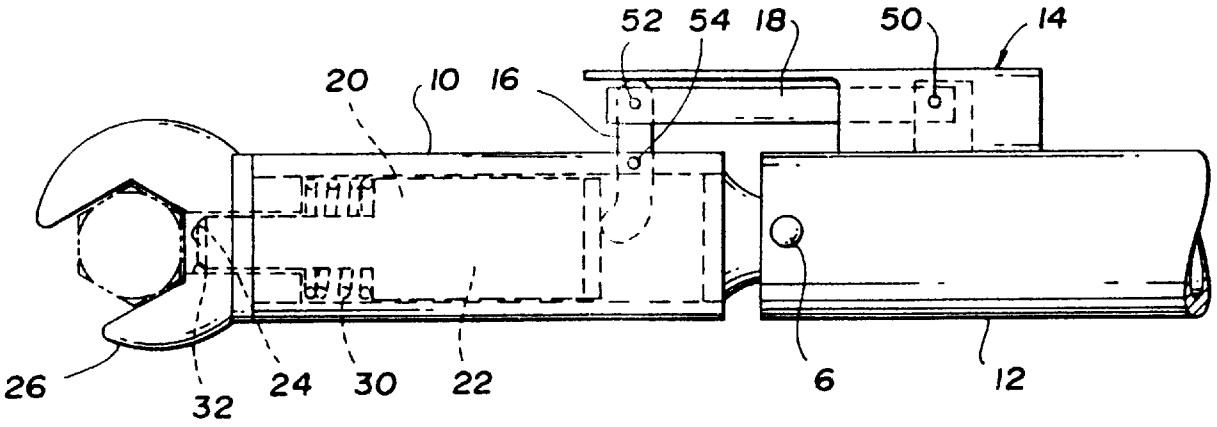
FIG. 1 shows a plan view of a torque limiting and marking wrench according to the present invention.
Figure 2:
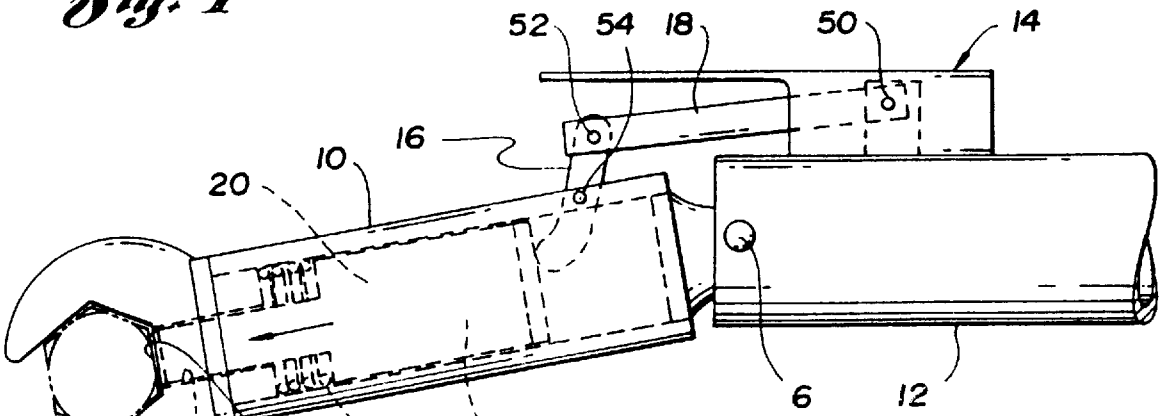
FIG. 2 shows a plan view of a torque limiting and marking wrench according to the present invention as a part is being marked.

Referring to FIGS. 1 and 2, a torque limiting and marking wrench according to the present invention is shown. This wrench is used to tighten fasteners. The torque-applying handle 12 is pivotally connected to the first end of the housing 10 at the pivot joint 6. When the wrench achieves a desired level of torque, the torque-applying handle 12 releases and pivots about the pivot joint 6, as shown in FIG. 2. The torque limiting aspect of the wrench is old and well known in the art and similar to that of U.S. Pat. No. 3,523,471 to Lance. This pivoting action creates relative pivotal movement between the handle 12 and the housing 10. The relative movement between the handle 12 and the housing 10 is used to actuate movement of the part-marking mechanism 20, thus marking the part when it has been tightened to a desired torque level.

A linkage arm 18 is pivotally connected to the torque-applying handle 12 at the first pivot 50. A second pivot 52 pivotally connects the linkage arm 18 to a first end of the pivotable cam 16. A third pivot 54 pivotally connects the pivotable cam 16 to the housing 10. The second end of the pivotable cam 16 is in operative engagement with the part-marking mechanism 20. The part-marking mechanism 20 is mounted within the housing 10 and is slidably movable therein.

The second end of the pivotable cam 16 pushes against the part-marking mechanism 20, thus sliding the part-marking mechanism 20 toward the part to be marked. The marking tip 24 extends through the bore 32 in the head assembly 26 to mark the part. A felt tip is used for the marking tip 24, which requires much less force to mark a part than did the previous metal striking pin, thus alleviating the need for pneumatic pressure lines. The felt marking tip also provides a more highly visible mark than a metal striking pin. After the part is marked by the marking tip 24, the return spring 30 returns the part-marking mechanism 20 toward the rear of the housing 10.

The head assembly 26 is releasably mounted within the second end of the housing 10 for engaging parts. The head assembly 26 is fully replaceable for different applications requiring a different head size. Furthermore, replacement of the ink cartridge 22 in the part-marking mechanism 20 may be accomplished by removing the head assembly 26 and sliding the part-marking mechanism 20 and return spring 30 out of the second end of the housing.

A mechanism cover 14 is mounted to the handle 12 and protects the linkage arm 18 and pivotable cam 16.

The range of pivotal motion of the handle 12 relative to the housing 10 is adjusted to accommodate the stroke required for the marking tip 24. For example, at least 15 degrees of rotational movement about the pivot joint 6 may be necessary to provide sufficient stroke to the marking tip 24 when using a standard felt-tip cartridge.

Figure 3:
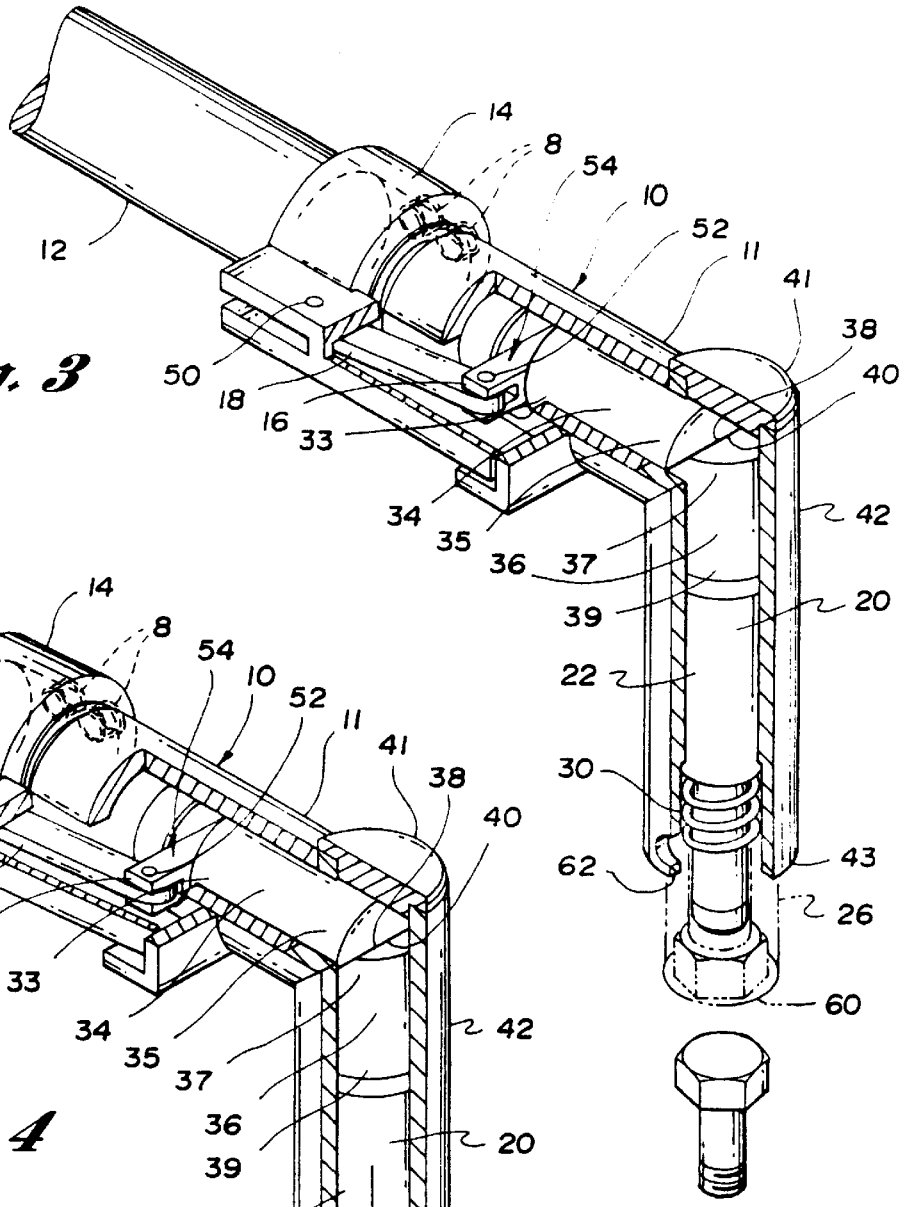
FIG. 3 shows a partially cut-away perspective view of an alternative torque limiting and marking wrench according to the present invention.
Figure 4:
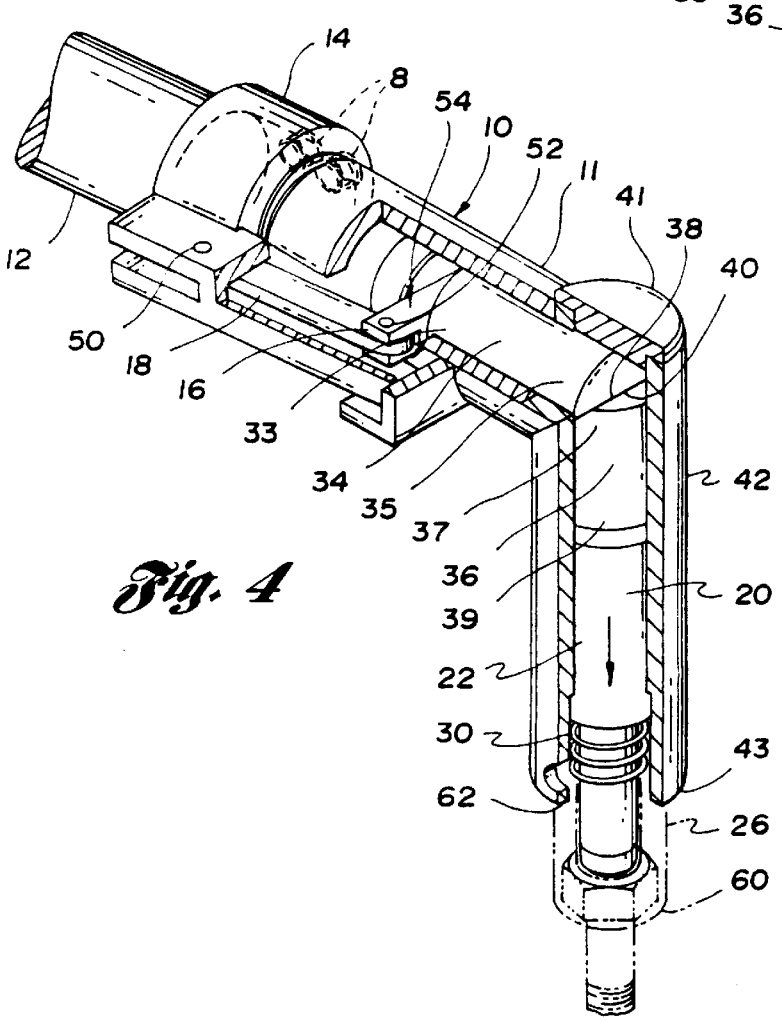
FIG. 4 shows a partially cut-away perspective view of an alternative torque limiting and marking wrench according to the present invention as a part is being marked.

Turning now to FIGS. 3 and 4, an alternative torque limiting and marking wrench according to the present invention is shown. This embodiment is generally used to employ a socket-type wrench.

The torque-applying handle 12 is pivotally connected to the first end of the housing 10 at the pivot joint, similar to the pivot joint 6 as shown in FIGS. 1 and 2. When the wrench achieves a desired level of torque, the torque-applying handle 12 releases and pivots about the pivot joint, as shown in FIG. 4. This pivoting action creates relative pivotal movement between the handle 12 and the housing 10. The relative movement between the handle 12 and the housing 10 is used to actuate movement of the part-marking mechanism 20, thus marking the part when it has been tightened to a desired torque level.

A linkage arm 18 is pivotally connected to the torque-applying handle 12 at the first pivot 50. A mechanism cover 14 is connected to the handle 12 and protects the linkage arm 18. A second pivot 52 pivotally connects the linkage arm 18 to a first end of the pivotable cam 16. A third pivot 54 pivotally connects the pivotable cam 16 to the housing 10.

A first plunger 34 is slidably movable within the housing 10. The second end of the pivotable cam 16 is in operative engagement with a first end 33 of the first plunger 34 for sliding the first plunger 34 along the housing 10. The second end 35 of the first plunger 34 has a cammed surface 38.

A first end 41 of the marking tube 42 is connected to the second end 11 of the housing 10. The second end 43 of the marking tube 42 is adapted to receive a releasably mounted, replaceable, part-engaging head assembly 26, the axis of the tube 42 being at an angle to the axis of the first plunger 34. The head assembly 26 includes a socket portion 60 having an open part-engaging area and a shank portion 62 which is releasably retained within the second end 43 of the marking tube 42.

A second plunger 36 is slidably movable within the marking tube 42. A first end 37 of the second plunger 36 has a cammed surface 40, which is in camming engagement with the cammed surface 38 at the second end 35 of the first plunger 34.

A part-marking mechanism 20 located within the marking tube 42 includes a marking tip 24 which passes through a bore 32 in the head assembly shank portion 62 for reciprocal movement. The part-marking mechanism 20 is slidably movable within the marking tube 42, and the marking tip 24 is extendible outwardly from the tube 42 for marking a part. The part-marking mechanism 20 is movable by the second plunger 36, such that, when torque on a part has reached a predetermined value, the torque applying handle 12 pivots relative to the housing 10, moving the linkage arm 18, which pivots the pivotable cam 16, and forces the second end of the pivotable cam 16 against the first end 33 of the first plunger 34, sliding the first plunger 34 along the tube 42, which causes the cammed surfaces 38, 40 of the first and second plungers 34, 36 to engage, and the second plunger 36 slides along the marking tube 42, which moves the part marking mechanism 20 toward the part to be marked. The marking tip 24 extends outwardly from the tube 42 to mark the part.

When the part has been marked, the handle 12 will return to its original position, as shown in FIG. 1, and the part-marking mechanism 20 will return toward the first end 41 of the marking tube 42 with the aid of the return spring 30.

The part-marking mechanism 20 includes a replaceable ink cartridge 22 therein. The cartridge 22 is refillable and reusable, and may be filled with any desired color, including known dyes and inks which may be washed off the part after inspection.

The second end 43 of the marking tube 42 is designed to accommodate different socket sizes, thus allowing quick and simple socket size changes.

The relative angle between the axis of the marking tube 42 and the axis of the first plunger 34 may be varied to achieve a desired configuration for differing manufacturing environments.

Figures 5, 6, 7:
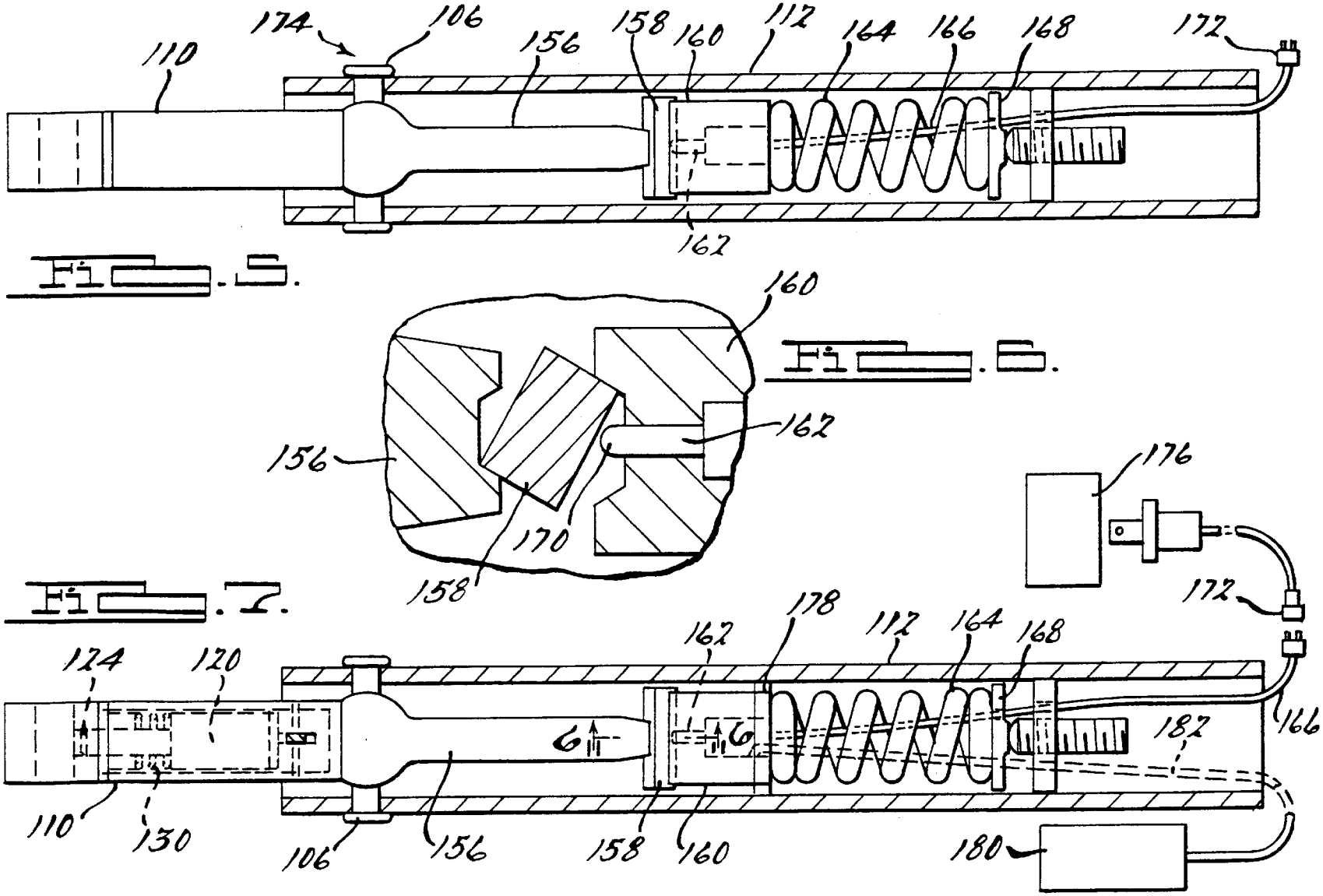
FIG. 5 shows a plan view of an electronic torque limiting wrench according to the present invention.
FIG. 6 shows an enlarged view of the electronic switch in the torque limiting wrench.
FIG. 7 shows a plan view of an electronic torque limiting and part marking wrench according to the present invention.

FIGS. 5 and 6 show an alternate embodiment for an electronic torque limiting wrench 174. The electronic torque limiting wrench 174 includes a handle 112 and a housing 110 which is pivotally connected to the handle 112 at a pivot point 106. The housing 110 includes on one end thereof, a replaceable part engaging head assembly which allows for different sizes of wrench heads to be easily snapped in and out of the housing unit 110. The opposite end of the housing unit 110 is connected via pivot point 106 to the handle 112 of the wrench.

A click arm 156 is also connected at this pivot point 106 and extends away from the housing 110. The click arm 156 rotates around the pivot point 106 in unison with the housing 110. The end of the click arm 156 opposite the pivot point 106 is in contact with a pawl member 158. The pawl member 158 is also in contact with an electronic switch 162 and cam member 160. The surface of the cam 160 includes an orifice. The switch 162, which is electrically connected to a data collection device or electronic signal processor 176, is placed in the orifice so the end 170 of the switch protrudes from the cam member 160. The data collection device 176 can be any sort of bar code reader, computer or any other type of mechanism capable of counting variations of electrical signals. In the preferred embodiment the data collection device 176 is a microcomputer system.

During normal operation of the electronic torque limiting wrench 174 the switch mechanism 162 is fully enclosed within the cam member 160. The push button switch end 170 is compressed within the cam member 160 by the pressure and force of the pawl 158 against the cam member 160. With the push button switch 170 compressed it creates an open circuit and does not send an electrical signal to the data collection device 176. When a part has attained a predetermined torque level the click arm 156 of the electronic torque wrench 174 will rotate the pawl 158 off of the surface of the cam member 160. This release of the pawl pressure will allow the push button switch 170 to extend outwardly in its fully open position. When the switch 170 is fully extended it closes the circuit and sends an electronic signal to the data collection device 176 via an electrical cable 166 or other electrical connection. This will enable the electronic wrench user to keep a log of which parts are torqued within a computer environment.

The opposite end of the cam member is in contact with one end of a spring member 164. The spring member 164 adjusts the amount of torque the wrench will deliver. The opposite end of the spring member 164 is connected to an adjusting plate 168 which allows for the user to precisely dial in the amount of torque the wrench is to provide. If the plate 168 is pushed in, more torque is delivered to the part whereas when it is released less torque will be delivered to the part.

An electrical connection 166 is connected from the switch mechanism 162 within the cam 160 to the data collection device 176 via at least one pin connector 172. The pin connectors 172 have been chosen because of their ease of use, their quick release capability during repairs and the ability to quickly release them when adjusting the torque setting for the wrench. Other methods may be used for the electrical connection 166 such as soldering wires or any other known method to send an electrical signal from a switch through to a data collection device. The switch used in this embodiment is an Archer 278-021 momentary push button switch. However, it should be noted that many other types of switches could be activated upon release of a torquing force and are suitable for use as the switching mechanism. For example, a simple contact switch may be used whereby the cam member 160 could close the electrical circuit when in the compressed or off position. Other switches such as capacitance switches, proximity switches, velocity switches and many other switches could also be used to turn the electrical circuit on and off. The electrical connection 166 and switch 162 together send a signal to the data collection device 176 verifying that a certain torque level has been reached. The data collection device 176 may also include a device for electronically inputting a signal such as a bar code reader, which scans in the VIN number, or any other type of number, and matches the VIN number with the fact that all parts of a vehicle have been torqued to a predetermined value, such as Lemelson U.S. Pat. No. 5,119,205. The combination of a Lemelson type scanner and the electronic torque wrench will allow for a method to track and log a vehicle to ensure all parts have been torqued to the necessary level.

The electronic torque enabling wrench 174 may also have a micrometer adjustable plate 168 such that the torque can be adjusted and quickly changed without having to put a torque tester on the wrench to determine the amount of torque actually being applied. The electronic torque wrench 174 may also be configured as an in-line wrench. The in-line wrench has an interchangeable adapter hand so various size parts can be tightened. The in-line wrench operates in the same manner as the above described wrench except that it marks the part being tightened on its side instead of on its top surface.

FIG. 7 shows another embodiment of the present invention combining the electronic torque limiting wrench 174 which records verification of a certain torque being reached and the ink marking capabilities of the torque wrench into one wrench. In the combination ink marking wrench and electronic wrench, the handle includes the electrical output circuitry necessary for the verification process, as discussed above, while the housing includes the ink marking capabilities of the wrench, as discussed above.

The electronic torque wrench 174 may also include a load cell 178. The load cell 178 is placed between the cam 160 and the torque spring 164. The load cell 178 is electronically connected to an electrical conversion circuit and monitor or display 180. The load cell 178 will digitally read the force of tension being applied by the wrench. This digital information will be transferred to the converter via the electrical connection 182. The convertor will convert the digital electrical signal to in-lbs, ft-lbs, or Newtons and display the value on the monitor 180 for the user. The monitor 180 will also provide information to the user regarding if the wrench is ready to start tightening the next part. The monitor will also display an "OK" output when the wrench reaches a predetermined torque value.

While the best modes for carrying out the invention have been described in detail, those familiar with the art to which the invention relates will recognize various alternative designs and embodiments for practicing the invention as defined by the following claims.

What is claimed is:

1. An electronic torque limiting wrench including:

a torque-applying handle;

a housing pivotally mounted at a first end to the torque-applying handle, said housing adapted to receive a part engaging head assembly at a second end thereof;

a switch mechanism mounted within said torque-applying handle; and a click arm pivotably connected to said housing at one end thereof, a second end of said click arm in contact with a first end of a pawl, a second end of said pawl in contact with a cam surface at a first end of a cam, a second end of said cam connected to a first end of a spring, a second end of said spring connected to an adjustable plate; said click arm having nominal position and translating to a disengaging position when said wrench reaches a predetermined torque value, said switch mechanism being biased toward a first position and compressed toward a second position by said pawl when said click arm is in its nominal position, said click arm rotates said pawl off of the cam surface at said predetermined torque value, releasing said switch mechanism to return to its first position.

2. The electronic torque limiting wrench of claim 1 further including an electrical connection between said switch mechanism and a data collection device for transmitting signals generated by said switch mechanism.

3. The wrench of claim 2 further comprising means for reading part information and transmitting said information to said data collection device with relation to the signals generated by said switch mechanism.

4. The electronic torque limiting wrench of claim 1 further comprising an electrical connection between said switch mechanism and a data collection device wherein said electrical connection sends an electrical signal to verify a predetermined torque value has been obtained.

5. The electronic torque limiting wrench of claim 1 wherein said adjustable plate is used to select said predetermined torque value.

6. An electronic torque limiting wrench of claim 1 further including a micrometer means for adjusting the torque delivered by said wrench.

7. The electronic torque limiting wrench of claim 1 wherein said switch mechanism is placed within said cam, said switch extends outwardly from said cam when a predetermined torque level is reached.

8. The wrench of claim 1 further comprising an operator signaling device electrically connected to said switch mechanism.

9. The electronic torque wrench of claim 1, further including a data collection device electrically connected to said switch mechanism to register verification that the predetermined torque value has been obtained.

* * * * *